US010338538B2

(12) United States Patent
Kwon

(10) Patent No.: US 10,338,538 B2
(45) Date of Patent: Jul. 2, 2019

(54) WATCH TYPE TERMINAL

(71) Applicant: LG ELECTRONICS INC., Seoul (KR)

(72) Inventor: Heeyong Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/707,498

(22) Filed: Sep. 18, 2017

(65) Prior Publication Data

US 2018/0024505 A1 Jan. 25, 2018

Related U.S. Application Data

(63) Continuation of application No. 15/091,414, filed on Apr. 5, 2016, now Pat. No. 9,891,598.

(30) Foreign Application Priority Data

Jan. 21, 2016 (KR) ..... 10-2016-0007705

(51) Int. Cl.
*G04C 17/00* (2006.01)
*G04G 9/00* (2006.01)
(Continued)

(52) U.S. Cl.
CPC ..... *G04R 60/10* (2013.01); *G04C 17/0091* (2013.01); *G04G 9/0064* (2013.01);
(Continued)

(58) Field of Classification Search
CPC .... G04C 17/0091; G04R 60/00; G04R 60/02; G04R 60/06; G04R 60/10; G04G 9/02;
(Continued)

(56) References Cited

U.S. PATENT DOCUMENTS 4,413,915 A * 11/1983 Besson ..... G04G 9/0082 349/113
4,488,818 A * 12/1984 Saurer ..... G04G 9/0094 368/242
(Continued)

FOREIGN PATENT DOCUMENTS

KR 10-0770830 10/2007
KR 10-2011-0009570 1/2011
(Continued)

OTHER PUBLICATIONS

International Search Report dated Oct. 19, 2016 issued in Application No. PCT/KR2016/002583.
(Continued)

*Primary Examiner* — Edwin A. Leon
*Assistant Examiner* — Jason M Collins
(74) *Attorney, Agent, or Firm* — KED & Associates LLP

(57) ABSTRACT

There is disclosed a watch type terminal including a frame in which electronic components are mounted, a case configured to cover a lateral area of the frame, a display unit located in a front side of the case, a metal ring arranged in an edge area of a front side of the display unit, a window provided in a front side of the metal ring and configured to cover the display unit, a clock hand installed between the window and the display unit, a driving unit provided in a back side of the display unit, connected to one end of the clock hand through the display unit, and configured to vary the position of the clock hand, and a controller implemented to control the display unit, so that the user may see and tells the time even in case the display unit is turned off and the external design is improved. Even when the display unit is deactivated, the user may be provided with time information.

12 Claims, 5 Drawing Sheets

(51) Int. Cl.

| | |
|---|---|
| ***G04G 17/04*** | (2006.01) |
| ***G04R 60/02*** | (2013.01) |
| ***G04R 60/10*** | (2013.01) |
| ***G04R 60/00*** | (2013.01) |
| ***G04R 60/08*** | (2013.01) |

(52) U.S. Cl.
CPC ..... *G04G 17/045* (2013.01); *G04R 60/00* (2013.01); *G04R 60/02* (2013.01); *G04R 60/08* (2013.01)

(58) Field of Classification Search
CPC ..... G04G 17/04; G04G 17/045; G04G 17/08; G04G 21/04
See application file for complete search history.

(56) References Cited

U.S. PATENT DOCUMENTS

| | | | | |
|---|---|---|---|---|
| 4,629,329 | A * | 12/1986 | Komiyama | G04B 37/084 368/10 |
| 5,089,998 | A * | 2/1992 | Rund | G04G 13/02 368/230 |
| 5,528,559 | A * | 6/1996 | Lucas | G04B 47/00 368/10 |
| 5,740,130 | A * | 4/1998 | Grupp | G02F 1/133553 349/113 |
| 6,084,828 | A * | 7/2000 | Bland | G04G 9/0082 368/223 |
| 6,661,743 | B1 * | 12/2003 | Mafune | G04F 10/00 368/239 |
| 6,937,301 | B2 * | 8/2005 | Sekiguchi | G02F 1/13471 349/114 |
| 6,967,903 | B2 * | 11/2005 | Guanter | G04G 11/00 368/224 |
| 7,420,881 | B2 * | 9/2008 | Frenkel | G06F 1/3228 345/169 |
| 8,275,327 | B2 | 9/2012 | Yi et al. | |
| 2002/0048221 | A1 * | 4/2002 | Basturk | G02F 1/133533 368/84 |
| 2002/0060953 | A1 * | 5/2002 | Farine | G04C 3/14 368/69 |
| 2003/0123328 | A1 | 7/2003 | Guanter | |
| 2004/0013042 | A1 * | 1/2004 | Farine | G04B 47/048 368/10 |
| 2004/0145971 | A1 * | 7/2004 | Lau | G04B 45/0015 368/84 |
| 2004/0179433 | A1 | 9/2004 | Paratte | |
| 2006/0120222 | A1 * | 6/2006 | Mazzetti | G04B 19/30 368/223 |
| 2007/0109918 | A1 | 5/2007 | Furetta et al. | |
| 2007/0274161 | A1 | 11/2007 | Rydgren | |
| 2008/0151700 | A1 * | 6/2008 | Inoue | B60K 37/02 368/80 |
| 2012/0069716 | A1 | 3/2012 | Peng | |
| 2012/0170423 | A1 | 7/2012 | Fujisawa | |
| 2013/0135158 | A1 | 5/2013 | Faraone et al. | |
| 2014/0375513 | A1 | 12/2014 | Kang et al. | |
| 2015/0048979 | A1 | 2/2015 | Asrani et al. | |
| 2015/0078144 | A1 * | 3/2015 | Gong | G04C 17/0041 368/228 |
| 2015/0171916 | A1 | 6/2015 | Asrani et al. | |
| 2015/0301506 | A1 * | 10/2015 | Koumaiha | G04G 21/08 368/10 |
| 2016/0091867 | A1 | 3/2016 | Mansour et al. | |
| 2016/0306328 | A1 | 10/2016 | Ko et al. | |

FOREIGN PATENT DOCUMENTS

| | | |
|---|---|---|
| KR | 10-2015-0057841 | 5/2015 |
| KR | 10-2016-0004770 | 1/2016 |

OTHER PUBLICATIONS

United States Office Action dated Jul. 12, 2017 issued in U.S. Appl. No. 15/091,414.

* cited by examiner 100
151
103
101
152
155
121
123
122
101a
101b
102
102
102a
102b

WATCH TYPE TERMINAL

CROSS-REFERENCE TO RELATED APPLICATIONS

This application is a Continuation Application of prior U.S. patent application Ser. No. 15/091,414 filed Apr. 5, 2016, which claims priority under 35 U.S.C. § 119 to Korean Application No. 10-2016-0007705 filed on Jan. 21, 2016 in Korea, the entire contents of which is hereby incorporated by reference in its entirety.

BACKGROUND OF THE DISCLOSURE

Field of the Disclosure

Embodiments of the present disclosure relate to a watch type terminal having an analog clock hand.

Background of the Disclosure

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

As such functions become more diversified, the mobile terminal can support more complicated functions such as capturing images or video, reproducing music or video files, playing games, receiving broadcast signals, and the like. By comprehensively and collectively implementing such functions, the mobile terminal may be embodied in the form of a multimedia player or device.

As the functions become more diversified, not only hand-carry type mobile terminals but also wearable type mobile terminals which are wearable on body parts have been released recently. An exterior design is an important factor in a wearable terminal. When a display unit of the wearable terminal is deactivated, a letter input/output panel becomes dark and such a dark letter input/output panel becomes a disadvantage of the wearable terminal in external appearance. It is a question of a battery capacity to make the display unit activated at all times.

Moreover, the wearable terminal has restriction on size and it has a disadvantage of insufficient space for mounting diverse internal components. Especially, it is difficult to arrange the antennas using electromagnetic signals in such an insufficient space of the wearable terminal, because there is an issue of mutual interference.

SUMMARY OF THE DISCLOSURE

Accordingly, an object of the present invention is to address the above-noted and other problems.

An object of the present disclosure is to provide a watch type terminal which may utilize a metal structure as antenna.

Embodiments of the present disclosure may provide a watch type terminal including: a frame in which electronic components are mounted; a case configured to cover a lateral area of the frame; a display unit located in a front side of the case; a metal ring arranged in an edge area of a front side of the display unit; a window provided in a front side of the metal ring and configured to cover the display unit; a clock hand installed between the window and the display unit; a driving unit provided in a back side of the display unit, connected to one end of the clock hand through the display unit, and configured to vary the position of the clock hand; and a controller implemented to control the display unit.

The controller may further include GPS module implemented to receive GPS signal using the metal ring.

The metal ring may be connected to the controller via a pogo pin.

The controller may be implemented to control the clock hand by controlling the driving unit based on time information received via the metal ring.

The clock hand may include an hour hand and a minute hand, and the minute hand may be output on the display unit when the display unit is activated.

The display unit may include a display panel configured to output visual information; and an edge mold comprising metal and configured to cover an edge of the display panel, and the controller may further include NFC module connected to the edge mold and implemented to transmit and receive NFC signal.

The edge mold may include a metal coil wound around the display panel several times and a molding portion double-injection-molded in the metal coil.

The watch type terminal may further include a back side mold configured to cover a back side of the display panel.

The back side mold may be made of metal and comprises a spiral shaped slit or a plurality of arc-shaped slits.

The back side mold may be configured to transmit and receive NFC signal, together with the edge mold.

The watch type terminal may further include a boss formed in the back side mold; and a screw connected to the boss through the frame.

The controller may be implemented to transmit and receive the NFC signal via the screw.

The watch type terminal may further include a flexible printed circuit board configured to connect the display panel to the controller, wherein the edge mold is connected to the controller via the flexible printed circuit board and configured to transmit and receive the NFC signal.

The case may be made of metal and configured to transmit and receive Bluetooth signal and WI-FI signal.

According to at least one embodiment mentioned above, the user may see and tells the time even in case the display unit is turned off and the external design is improved. Even when the display unit is deactivated, the user may be provided with time information.

Furthermore, the GPS antenna, NFC antenna and Bluetooth/WI-FI antenna may be provided using the existing structures or components without any auxiliary antenna structures. Accordingly, the watch type terminal in accordance with the present disclosure may have more improved space utilization.

Still further, the antenna is positioned closer to the front side of the watch type terminal and the antenna of the watch type terminal in accordance with the present disclosure may have more improved performance.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

In accordance with still further embodiments, a watch type terminal may be configured as a device which is wearable on a human body. Such devices go beyond the usual technique of a user grasping the watch type terminal using their hand. Examples of the wearable device include a smart watch, a smart glass, a head mounted display (HMD), and the like.

Figure 1:
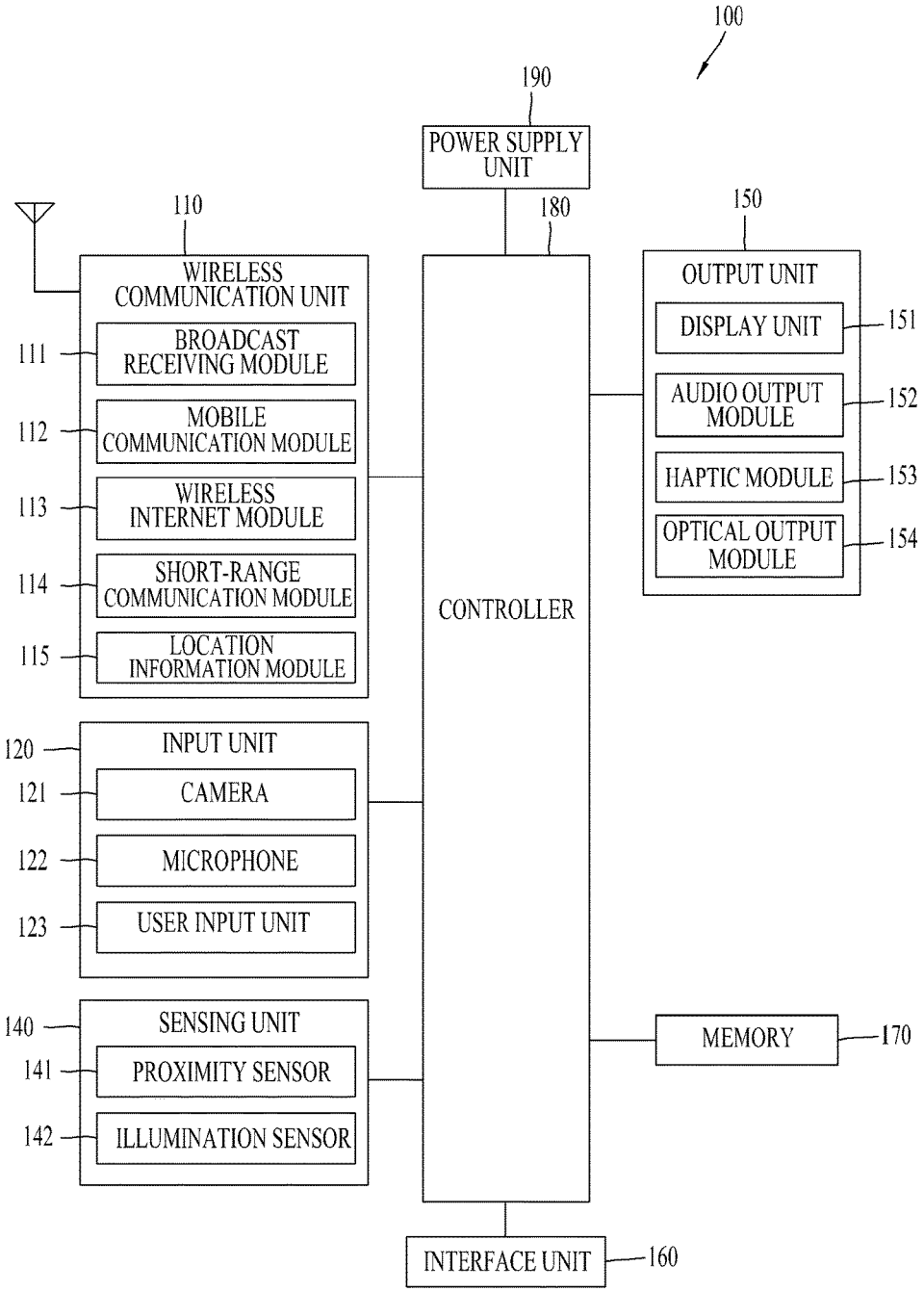
FIG. 1 is a block diagram of a mobile terminal in accordance with the present disclosure.

Reference is now made to FIG. 1, where FIG. 1 is a block diagram of a watch type terminal in accordance with the present disclosure. The watch type terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components is not a requirement, and that greater or fewer components may alternatively be implemented.

Referring now to FIG. 1, the watch type terminal 100 is shown having wireless communication unit 110 configured with several commonly implemented components. For instance, the wireless communication unit 110 typically includes one or more components which permit wireless communication between the watch type terminal 100 and a wireless communication system or network within which the watch type terminal is located.

The wireless communication unit 110 typically includes one or more modules which permit communications such as wireless communications between the watch type terminal 100 and a wireless communication system, communications between the watch type terminal 100 and another watch type terminal, communications between the watch type terminal 100 and an external server. Further, the wireless communication unit 110 typically includes one or more modules which connect the watch type terminal 100 to one or more networks.

To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the watch type terminal, the surrounding environment of the watch type terminal, user information, and the like. For example, in FIG. 1, the sensing unit 140 is shown having a proximity sensor 141 and an illumination sensor 142.

If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The watch type terminal 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154. The display unit 151 may have an inter-layered structure or an integrated structure with a touch sensor in order to facilitate a touch screen. The touch screen may provide an output interface between the watch type terminal 100 and a user, as well as function as the user input unit 123 which provides an input interface between the watch type terminal 100 and the user.

The interface unit 160 serves as an interface with various types of external devices that can be coupled to the watch type terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the watch type terminal 100 may perform assorted control functions associated with a connected external device, in response to the external device being connected to the interface unit 160.

The memory 170 is typically implemented to store data to support various functions or features of the watch type terminal 100. For instance, the memory 170 may be configured to store application programs executed in the watch type terminal 100, data or instructions for operations of the watch type terminal 100, and the like. Some of these application programs may be downloaded from an external server via wireless communication. Other application programs may be installed within the watch type terminal 100 at time of manufacturing or shipping, which is typically the case for basic functions of the watch type terminal 100 (for example, receiving a call, placing a call, receiving a message, sending a message, and the like). It is common for application programs to be stored in the memory 170, installed in the watch type terminal 100, and executed by the controller 180 to perform an operation (or function) for the watch type terminal 100.

The controller 180 typically functions to control overall operation of the watch type terminal 100, in addition to the operations associated with the application programs.

The controller 180 may provide or process information or functions appropriate for a user by processing signals, data, information and the like, which are input or output by the various components depicted in FIG. 1, or activating application programs stored in the memory 170. As one example, the controller 180 controls some or all of the components illustrated in FIG. 1 according to the execution of an application program that have been stored in the memory 170.

The power supply unit 190 can be configured to receive external power or provide internal power in order to supply appropriate power required for operating elements and components included in the watch type terminal 100. The power supply unit 190 may include a battery, and the battery may be configured to be embedded in the terminal body, or configured to be detachable from the terminal body.

Figure 2:
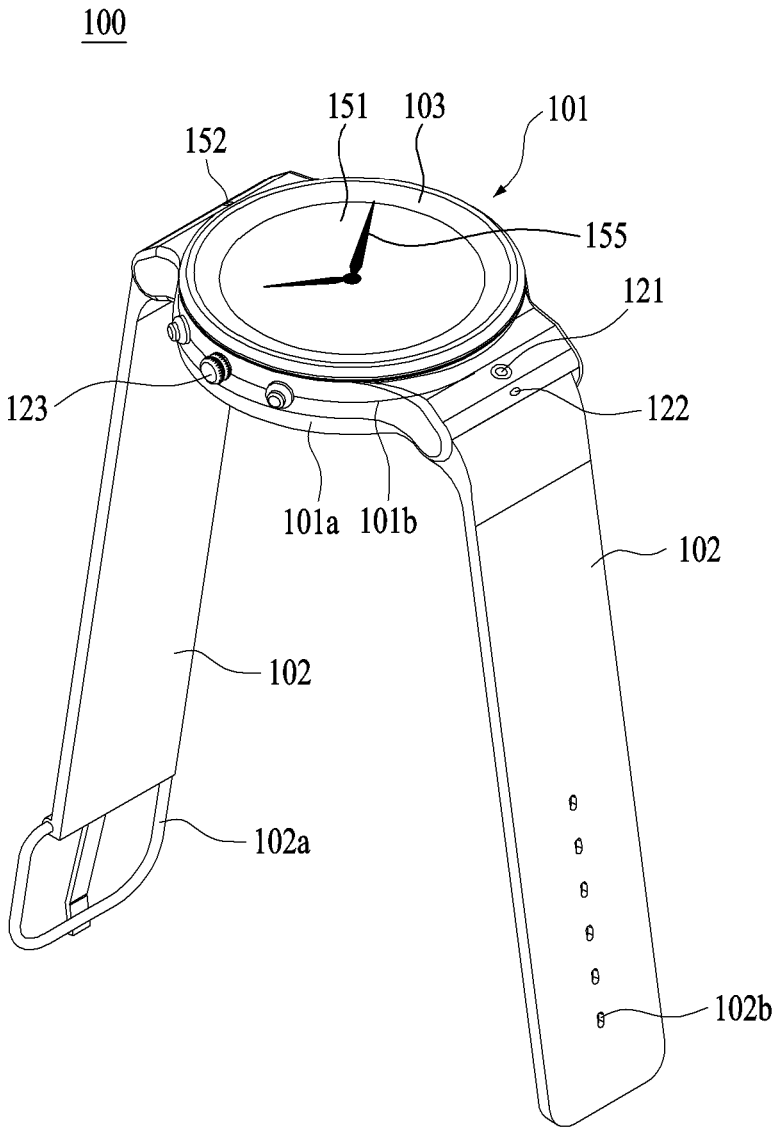
FIG. 2 is a perspective diagram of one example of a watch type terminal in accordance with another exemplary embodiment of the present disclosure.

FIG. 2 is a perspective view illustrating one example of a watch-type terminal 100 in accordance with another exemplary embodiment.

As illustrated in FIG. 2, the watch-type mobile terminal 100 includes a main body 101 with a display unit 151 and a band 102 connected to the main body 101 to be wearable on a wrist.

The main body 101 may include a case having a certain appearance. As illustrated, the case may include a first case 101*a* and a second case 101*b* cooperatively defining an inner space for accommodating various electronic components. Other configurations are possible. For instance, a single case may alternatively be implemented, with such a case being configured to define the inner space, thereby implementing a mobile terminal 100 with a uni-body.

The watch-type mobile terminal 100 can perform wireless communication, and an antenna for the wireless communication can be installed in the main body 101. The antenna may extend its function using the case. For example, a case including a conductive material may be electrically connected to the antenna to extend a ground area or a radiation area.

The display unit 151 is shown located at the front side of the main body 101 so that displayed information is viewable to a user. In some embodiments, the display unit 151 includes a touch sensor so that the display unit can function as a touch screen. As illustrated, window 151*a* is positioned on the first case 101*a* to form a front surface of the terminal body together with the first case 101*a*.

The illustrated embodiment includes audio output module 152, a camera 121, a microphone 122, and a user input unit 123 positioned on the main body 101. When the display unit 151 is implemented as a touch screen, additional function keys may be minimized or eliminated. For example, when the touch screen is implemented, the user input unit 123 may be omitted.

The band 102 is commonly worn on the user's wrist and may be made of a flexible material for facilitating wearing of the device. As one example, the band 102 may be made of fur, rubber, silicon, synthetic resin, or the like. The band 102 may also be configured to be detachable from the main body 101. Accordingly, the band 102 may be replaceable with various types of bands according to a user's preference.

The band 102 may include fastener 102*a*. The fastener 102*a* may be implemented into a buckle type, a snap-fit hook structure, a Velcro® type, or the like, and include a flexible section or material. The drawing illustrates an example that the fastener 102*a* is implemented using a buckle.

In case the buckle type fastener 102*a* is provided, the band may include a hole 102*b* formed in the other side of the buckle type fastener 102 in order to insert a fixing pin therein.

Figure 3:
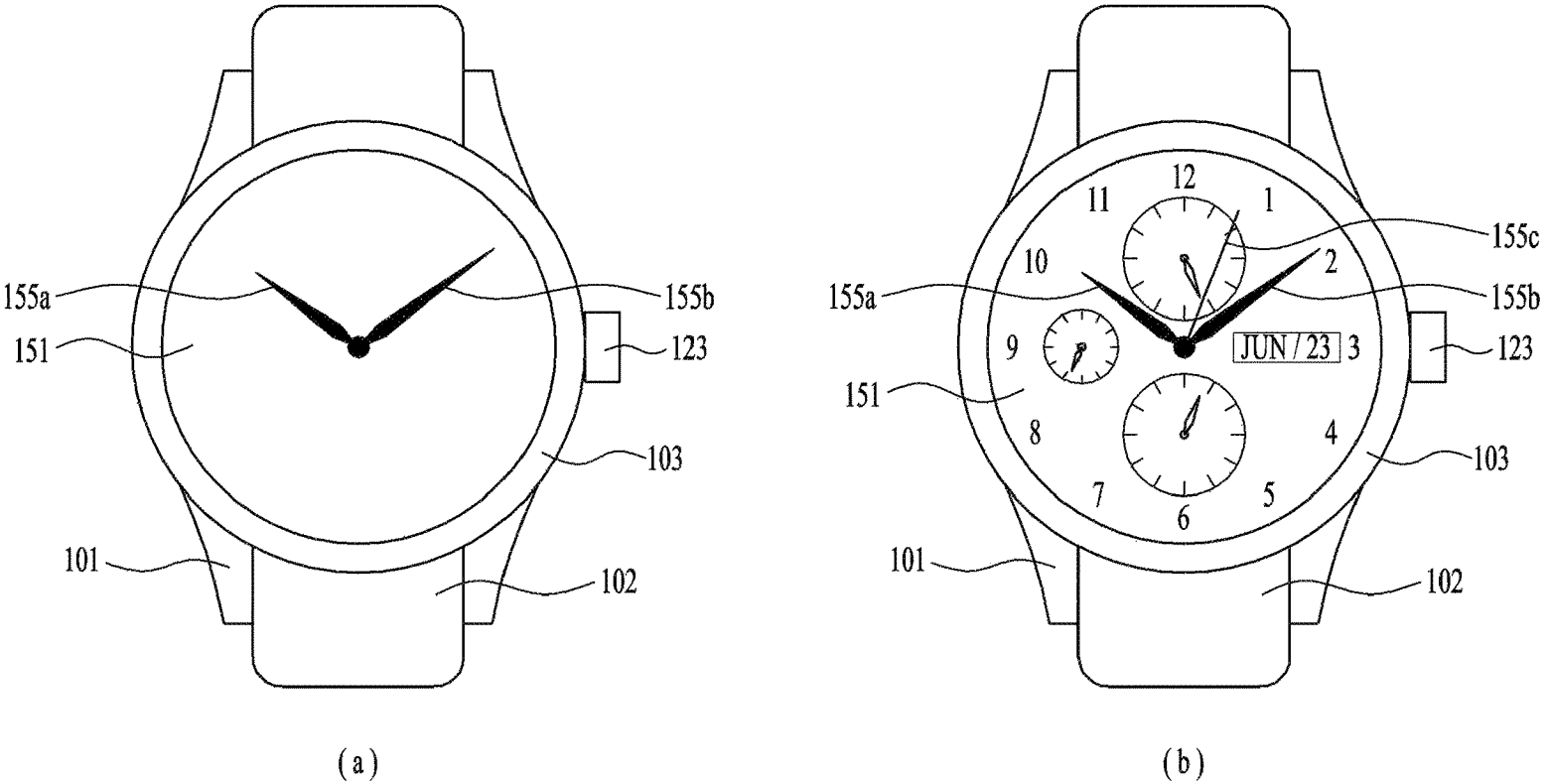
FIG. 3 is a plane view illustrating a display unit of one example of a watch type terminal.

FIG. 3 is a plane view illustrating a display unit of the watch type terminal, and (a) shows the display unit 151 is in a deactivated state and (b) shows the display unit 151 in an activated state to output a screen.

The watch type terminal 100 in accordance with the embodiment includes clock hand 155 arranged between the display unit 151 and glass so that it may be used as conventional analog watch having clock hand even when the display unit 151 is not activated or went off. The clock hand 155 may include all of hour, minute and second hands, or alternatively include hour and minute hands with a second hand which is displayed on the display unit 151 when the display unit 151 is activated.

The display unit 151 may have a clock-face board which is output around in an edge section to show calibration and output day and date, time in different place, temperature, humidity or weather as additional information.

When the user tries to use other functions of the watch type terminal than the watch function, one or more of icons are output like a conventional watch type terminal and allow the user to implement functions of the watch type terminal by touch input or using user input unit. Icon arrangement may be variable according to the locations of the clock hand 155.

The illustrated example of the watch type terminal is shown as a circular wrist watch and the examples of the present disclosure are not restricted thereto. Shapes of the examples may include diverse polygonal shape such as a rectangular shape and the like.

Figure 4:
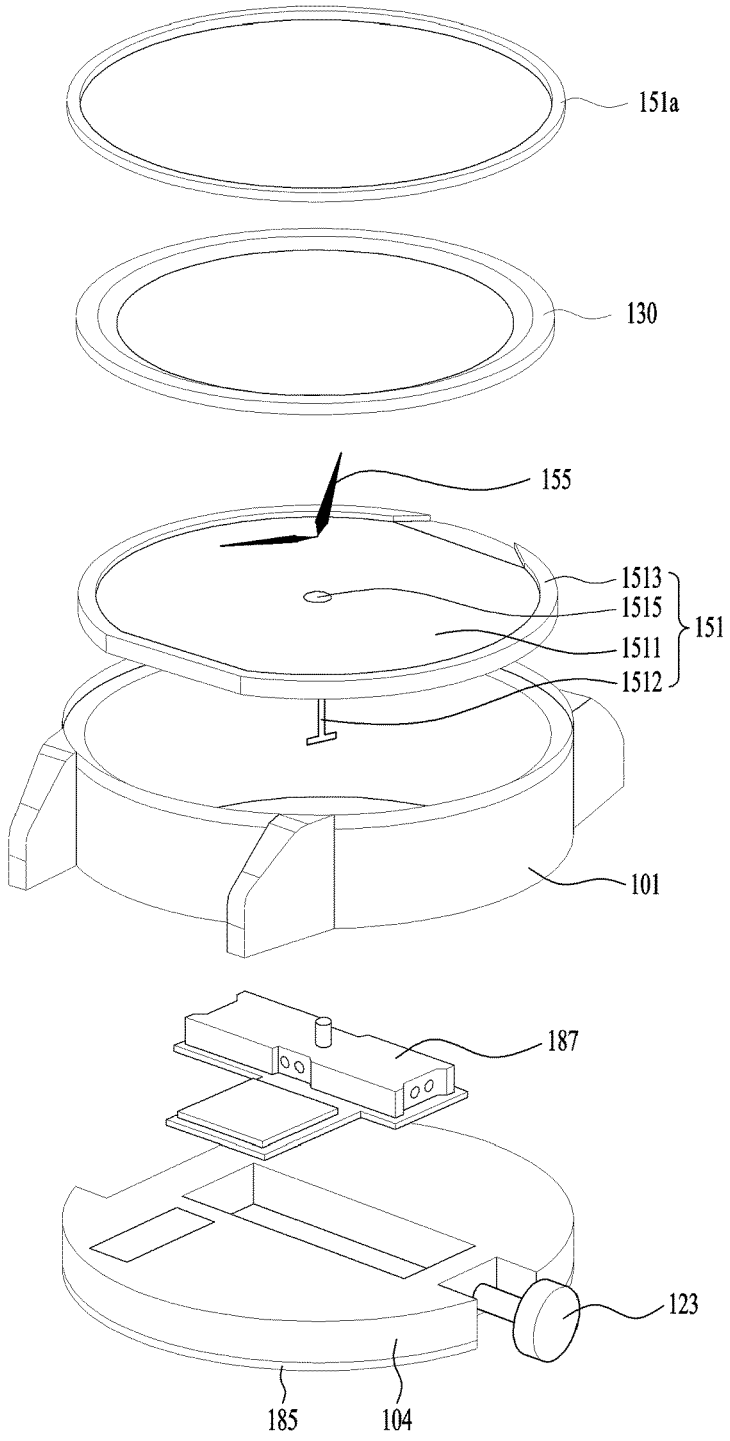
FIG. 4 is an exploded perspective diagram of one example of a watch type terminal in accordance with the present disclosure.

FIG. 4 is an exploded perspective diagram of the watch type terminal. The main body of the watch type terminal in accordance with the present disclosure. The main body of the terminal includes a case 101 configured to define an external side appearance of the main body, a display unit 151 coupled to a front surface of the case 101, a clock hand 155 arranged on a front surface of the display unit 151, a window 151*a* configured to forming an external front side, covering the clock hand 155 and the display unit 151, a metal ring 103 configured to define a certain space between the window 151*a* and the display unit 101, a driving unit 180 implemented to drive the clock hand 155, a controller 180 provided in the case 101 and implemented to control components such as the display 151, and a rear cover (not shown) configured to cover a back side of the main body.

The clock hand 155 is arranged on a front surface of the display unit 151. One section of the clock hand 155 is positioned in a center of the display unit 151 and the location pointed by the other section of the clock hand 155 tells the time. To drive the clock hand 155, one section of the clock hand 155 is connected to a driving unit 180 projected through the display unit 151. The driving unit 180 is implemented to change the locations of the clock hand 155 on a preset cycle and for the clock hand to indicate the time. The locations and operation or function of the clock hand 155 may be varied according to a design of the watch type terminal.

The conventional display unit 151 and the window 151*a* disposed on a front surface of the display unit 151 are in close contact with each other. However, in the illustrated embodiment, the clock hand 155 is arranged between the two components and a predetermined space is required between the window 141*a* and the display unit 151. Accordingly, the metal ring 103 is further provided for the arrangement of the clock hand 155. The metal ring 103 has a certain width in order to cover a deactivated area around the display unit 151 and a frame area of the display unit 151. Also, it has a certain thickness corresponding to a height which is sufficient not to interfere in the driving of the clock hand 155.

The metal ring 103 shown in FIG. 4 has an inclined surface which becomes thinner toward a center of a circle and thicker toward an outer rim. Without the inclined surface, a step formed between the metal ring 103 and the display unit 151 is visible so that a distance between the display unit 151 and the window 151*a* can be visually noticed. However, the inclined surface may reduce continuity between the display unit 151 and the metal ring 103.

The metal ring 103 includes a metal material and serves as antenna. For instance, the metal ring 103 may function as antenna of GPS (Global Positioning System) implemented to receive information of the location information module 115. Such a GPS module is implemented to receive and transmit a signal, using a signal in approximately 1.5 GHz band and to receive location information of a mobile terminal from a satellite in order to position a present location of the mobile terminal.

The GPS antenna is sensitive to noise and it is preferred that the GPS antenna is arranged in a position less affected by other components. The GPS antenna is arranged in the outmost position in order to reduce the noise which is generated under the influence of the other components.

When current location information is received, a point of a current position may be displayed based on map information and information associated with the current position may be additionally obtained. For instance, time information, weather information, event information and the like associated with the current position may be additionally received via other wireless communication modules (for example, a mobile communication module) based on the location information received by the GPS antenna.

The received GPS signal may be transmitted to the main board 185 (in other words, the controller) via the metal ring 103. The metal ring 103 may be connected to the main board 185, using a material such as a pogo pin, an elastic clip or the like.

The display unit 151 may include a display panel 1511 implemented to control each pixel according to visual information and an edge mold arranged in edge of the display panel 1511 while supporting the display unit 151.

The edge mold 1513 may include a metallic material and the edge mold 1513 may also serve as antenna. It is preferred that the edge mold 1513 functioned as antenna receives a signal in a different frequency range to avoid frequency interference in case of using the metal ring 103 mentioned above as antenna. For instance, the edge mold 1513 may function as NFC antenna implemented to receive and transmit a signal of NFC (Near Field Communication) module. The NFC module uses a signal in 13.56 MHz band.

NFC is implemented to receive and transmit a signal within a near field of 10 cm and uses a low frequency band signal. A certain length of the antenna has to be secured to use low frequency signal. Accordingly, a mold double-injected is attached to a plurality of coils wound several times to form the edge mold 1513.

Figure 5:
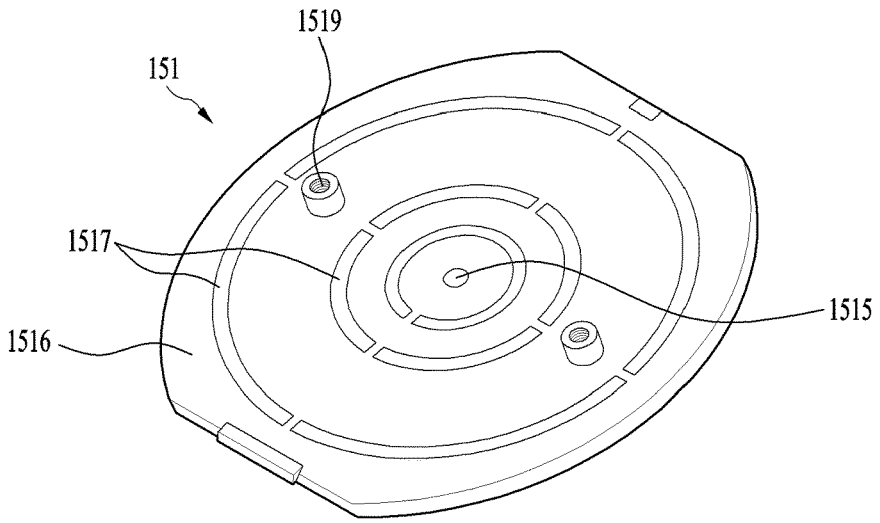
FIG. 5 is a diagram illustrating a back side of a display unit provided in one example of a watch type terminal in accordance with the present disclosure.

FIG. 5 is a diagram illustrating a back side of a display unit 151 provided in one example of a watch type terminal in accordance with the present disclosure. In the drawing, a back side mold may be further provided rather that the edge mold 1513 and support a back side of a display panel 1511. The back side mold 1516 is configured to support the force applied along a direction to a surface direction of the display unit 151 in order to protect the display unit 151.

The back side mold may also include a metallic material like the edge mold 1513. The back side mold 1516 may be used in case an additional length of the antenna has to be secured to receive and transmit NFC signal. The back side mold 1516 is cut away and a plurality of arc-shaped slits 1517 is formed in order to obtain an effect of coil. The back side mold 1516 is required to have a certain rigidity or more so that it may be cut away not in a bar shape but in an arc shape to be partially connected. The number of the arcs may be variable according to frequency matching of NFC antenna.

A frame 104 arranged in the back side of the display unit 151 has one or more of unevenness and holes which are corresponding to shapes of components to mount diverse electronic component therein. The frame 104 is arranged in the case 101. Examples of the components mounted in the frame 104 include a main board 185 on which various chips are mounted as the controller 180, a driving unit 180 implemented to control the clock hand 155, a battery, a wireless communication unit and the like.

The display unit 151 may also include a boss 1519 provided in a back side thereof to be fixed to the frame as shown in FIG. 5. The display unit 115 may be coupled to the frame through the boss 1519 by using a screw. The screw may be connected to the main board 185 to function as a feeding line and a ground line for applying power to the edge mold 1513 and the back side mold 1516 of the display unit 151. With no other auxiliary connection structure, the edge mold 1513 and the back side mold 1516 may function as radiator for NFC module.

NFC wireless communication may be implemented by near contact or touch so that components or devices for NFC wireless communication may be arranged closer to a front side than a back side of the main body. Different from the conventional terminal, such the watch type terminal is in contact with the user's wrist. It is much easier to position the display unit 151 close to NFC devices.

Bluetooth antenna and WI-FI antenna may be embedded in the case 101 exposed in a lateral direction. Bluetooth is implemented for wireless data communication between wireless communication devices or systems to transmit and receive signals within 10*m*. For instance, the watch type terminal having such Bluetooth antenna may be connected to Bluetooth earphones to provide the user with audio information or connected to another mobile terminal to receive data therefrom. Such Bluetooth uses signals in 2.4G~2.5G band and reduces interference from other systems.

WI-FI is implemented using divided channels in 2.4 GHz band to transmit and receive data to and from AP (Access Point) positioned in a near field wirelessly. Such WI-FI having two channels uses similar frequency bands and performs two functions, using one antenna. The case made of metal may serve as antenna. Frequency matching may be performed by adjusting the width and thickness of the case 101.

An electric insulation material may be disposed between each two of the metal ring 103, the edge mold 1513 and the case 101 that are mentioned before, to electrically insulate them from each other. For example, Teflon tape may be disposed each two of the components.

The main board 185 is implemented to control the display unit 151 in order to provide visual information, and other components (for example, a speaker, a microphone, a camera or the like). Also, the main board 185 is connected to the metal ring 103, the edge mold 1513 and the back side mold 1516 that are mentioned above and the case in order to transmit and receive a wireless signal to and from the components. The main board 185 may be connected to the components by using a pogo pin or clip and it may be implemented to provide the information received using the wireless communication module mentioned above on the display unit 151.

For instance, the main board 185 is implemented to receive time information or weather information via the Bluetooth and WI-FI antennas mentioned above based on the location information received using the metal ring 103 (as GPS antenna). The main board 185 is implemented to output the information on the display unit 151 and, by extension, to control the driving unit 180 in order to automatically adjust the clock hand 155 according to the time information of the location.

Figure 6:
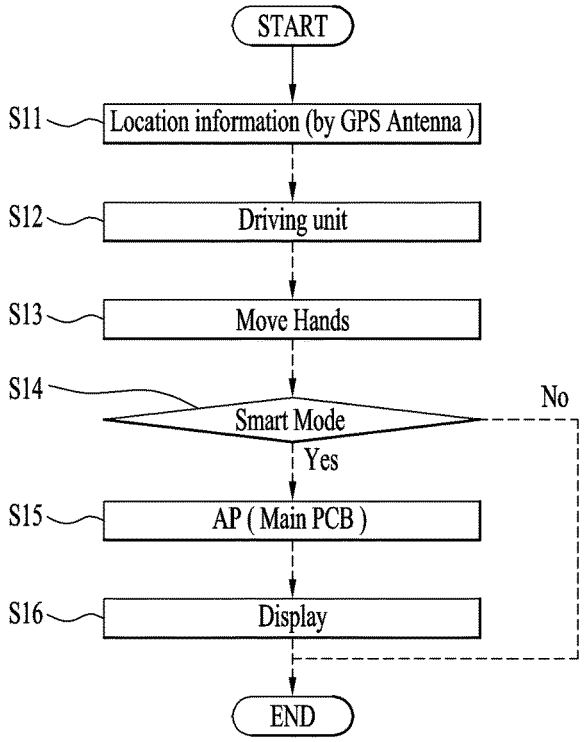
FIG. 6 is a flow chart illustrating a method for controlling the watch type terminal, using GPS thereof.

FIG. 6 is a flow chart illustrating a method for controlling one example of the watch type terminal using GPS. Location information is received by using GPS antenna (S11) and the received location information is transmitted to the driving unit 180 implemented to control the clock hand 155 (S12). The driving unit 180 is implemented to move the clock hand 155 in order to re-set the time according to the location information (S13).

If the watch type terminal is in a smart mode in which other information rather than the time provided by using the clock hand can be provided on the activated display unit 151 (S14), the information is transmitted to the main board 185 (S15) and information based on the location information is provided to the display unit 151 (S16). In other words, a minute hand or time information about a preset basic location may be output on the display unit 151.

According to the method for controlling the mobile terminal in accordance with the present disclosure as described above, the user may see and tells the time even in case the display unit 151 is turned off and the external design is improved. Even when the display unit 151 is deactivated, the user may be provided with time information.

Furthermore, the GPS antenna, NFC antenna and Bluetooth/WI-FI antenna may be provided using the existing structures or components without any auxiliary antenna structures. Accordingly, the watch type terminal in accordance with the present disclosure may have more improved space utilization.

Still further, the antenna is positioned closer to the front side of the watch type terminal and the antenna of the watch type terminal in accordance with the present disclosure may have more improved performance.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A watch type terminal comprising:

a frame in which electronic components are mounted;

a case configured to cover a lateral area of the frame;

a display unit located in a front side of the case;

a metal ring arranged in an edge area of a front side of the display unit;

a window provided in a front side of the metal ring and configured to cover the display unit;

an hour clock hand and a minute clock hand installed between the window and the display unit;

a driving unit provided in a back side of the display unit, connected to one end of the hour clock hand and the minute clock hand through the display unit, and configured to vary the position of the hour clock hand and the minute clock hand; and a controller implemented to control the display unit to output a second clock hand when the display is activated, wherein the display unit comprises:

a display panel configured to output visual information; and a mold configured to cover an edge and a back side of the display panel, the mold comprising metal, and wherein the controller comprises an NFC module connected to the metal of the mold and implementing to transmit and receive NFC signals.

2. The watch type terminal of claim 1, wherein the controller further comprises:

a GPS module implemented to receive GPS signal using the metal ring.

3. The watch type terminal of claim 2, wherein the metal ring is connected to the controller via a pogo pin.

4. The watch type terminal of claim 2, wherein the controller is implemented to control the hour clock hand and the minute clock hand by controlling the driving unit based on time information received via the metal ring.

5. The watch type terminal of claim 1, wherein the mold comprises:

an edge mold configured to cover the edge of the display panel.

6. The watch type terminal of claim 5, wherein the edge mold comprises a metal coil wound around the display panel several times and a molding portion double-injection-molded in the metal coil.

7. The watch type terminal of claim 1, wherein the mold comprises:

a back side mold configured to cover the back side of the display panel.

8. The watch type terminal of claim 7, wherein the back side mold is made of metal and comprises a spiral shaped slit or a plurality of arc-shaped slits.

9. The watch type terminal of claim 7, further comprising:

a boss formed in the back side mold; and a screw connected to the boss through the frame.

10. The watch type terminal of claim 9, wherein the controller is implemented to transmit and receive the NFC signals via the screw.

11. The watch type terminal of claim 1, further comprising:

a flexible printed circuit board configured to connect the display panel to the controller, wherein the mold is connected to the controller via the flexible printed circuit board and configured to transmit and receive the NFC signals.

12. The watch type terminal of claim 1, wherein the case is made of metal and configured to transmit and receive Bluetooth signals and Wi-Fi signals.

* * * * *